US006003297A

United States Patent [19]

Ziegner

[11] Patent Number: 6,003,297

[45] **Date of Patent: *Dec. 21, 1999**

[54] METHOD AND APPARATUS FOR OPERATING A GAS TURBINE, WITH FUEL INJECTED INTO ITS COMPRESSOR

[75] Inventor: Manfred Ziegner, Mülheim/Ruhr, Germany

[73] Assignee: Siemens Aktiengsellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,566

[22] Filed: Sep. 8, 1997

Related U.S. Application Data

[63] Continuation of application No. PCT/DE96/00386, Mar. 5, 1996.

[30] Foreign Application Priority Data

Mar. 6, 1995 [DE] Germany ..... 195 07 763

[51] Int. Cl.[6] ..... F02C 7/00; F02C 7/22

[52] U.S. Cl. ..... 60/39.06; 60/726; 60/740

[58] Field of Search ..... 60/39.06, 39.27, 60/39.29, 740, 726, 728; 415/149.4

[56] References Cited

U.S. PATENT DOCUMENTS

| | | | |
|---|---|---|---|
| Re. 32,896 | 3/1989 | Hargis . | |
| 2,630,678 | 3/1953 | Pratt | 60/726 |
| 2,671,314 | 3/1954 | Lichty | 60/39.02 |
| 2,755,623 | 7/1956 | Ferri et al. . | |
| 3,019,606 | 2/1962 | Franz . | |
| 3,299,632 | 1/1967 | Wilde et al. . | |
| 3,327,933 | 6/1967 | Baumann et al. | 415/149.4 |
| 3,701,255 | 10/1972 | Markowski . | |
| 5,062,792 | 11/1991 | Maghon . | |
| 5,207,064 | 5/1993 | Ciokajlo . | |

FOREIGN PATENT DOCUMENTS

| | | | |
|---|---|---|---|
| 0 193 838 | 9/1986 | European Pat. Off. . | |
| 0 276 696 | 8/1988 | European Pat. Off. . | |
| 0 489 193 | 6/1992 | European Pat. Off. . | |
| 0 590 297 | 4/1994 | European Pat. Off. . | |
| 1592655 | 9/1990 | Russian Federation | 60/740 |
| 2 075 659 | 11/1981 | United Kingdom . | |

OTHER PUBLICATIONS

Treager, Erwin E. *Aircraft Gas Turbine Technology* McGraw Hill, New York, 1970. Figures 5–6 and 3–17(b).

*Primary Examiner*—Louis J. Casaregola
*Attorney, Agent, or Firm*—Herbert L. Lerner; Laurence A. Greenberg

[57] ABSTRACT

A gas turbine and a method for combustion of a fuel in a gas turbine, conduct a flow of compressed air through the gas turbine from a compressor section to a turbine section. The fuel is fed to the flow in the compressor section and is burnt in the flow between the compressor section and the turbine section. The flow is subjected to a spin with a speed component at right angles to a movement direction of the flow when the flow emerges from the compressor section. The combustion of the fuel increases the speed component in the movement direction of the flow, causing the speed of the flow entering the turbine section to correspond to a value predetermined by the geometry of the turbine section.

15 Claims, 1 Drawing Sheet

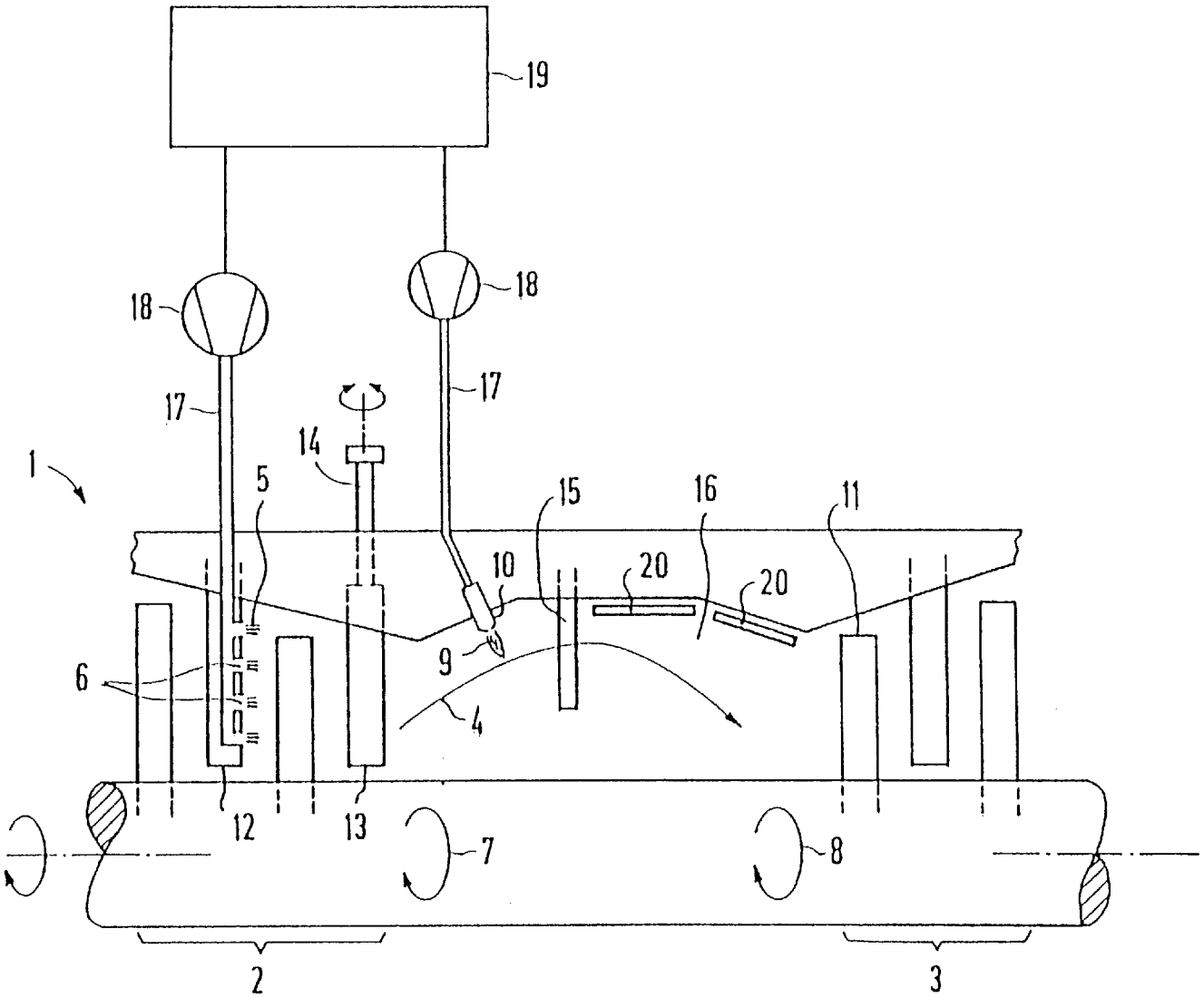
1
2
3
4
5
6
7
8
9
10
11
12
13
14
15
16
17
18
19
20

METHOD AND APPARATUS FOR OPERATING A GAS TURBINE, WITH FUEL INJECTED INTO ITS COMPRESSOR

CROSS-REFERENCE TO RELATED APPLICATION

This application is a continuation of International Application Ser. No. PCT/DE96/00386, filed Mar. 5, 1996.

BACKGROUND OF THE INVENTION

Field of the Invention

The invention relates to a method for combustion of a fuel in a flow of compressed air which passes through a gas turbine from a compressor section to a turbine section, wherein the fuel is added to the flow in the compressor section and is burnt between the compressor section and the turbine section. The invention also relates to a corresponding gas turbine.

Such a method and such a gas turbine have been disclosed in U.S. Pat. No. 2,630,678.

Published European Patent Application 0 590 297 A1 discloses a gas turbine having a compressor section, an annular combustion chamber and a turbine section. The compressor section provides a flow of compressed air which has fuel added to it in the annular combustion chamber after which the fuel is ignited and burnt. The flow is passed to the turbine section after the combustion has taken place. That document refers to the gas turbine as a "gas turbine assembly", the compressor section as a "compressor" and the turbine section as a "turbine". The different terminology is a result of the fact that the term "gas turbine" is not used in a standard manner in the specialist world. The term "gas turbine" may refer both to a turbine in the narrow sense, that is to say an engine which extracts mechanical energy from a flow of heated gas, and to a unit including a turbine in the narrow sense as well as a combustion chamber or combustion chambers and a compressor section. In the present context, the term "gas turbine" always refers to a unit which, in addition to a turbine in the narrow sense, that is always referred to as a "turbine section" in this document, also includes at least one associated compressor section.

Examples of burners which can be used in a gas turbine can be found in Published European Patent Application 0 193 838 B1, U.S. Pat. No. Re. 33896, Published European Patent Application 0 276 696 B1 and U.S. Pat. No. 5,062,792. A combustion chamber in the form of an annular combustion chamber having a multiplicity of burners disposed in the form of an annular ring is described in Published European Patent Application 0 489 193 A1.

Further information relating to the construction of a combustion device which can be disposed between a compressor section and a turbine section of a gas turbine is disclosed in U.S. Pat. Nos. 2,755,623; 3,019,606; 3,701,255 and 5,207,064. That information includes configurations for the implementation of combustion devices in which a flow of compressed air is carried with a spin and the combustion possibly also takes place in the spinning flow. Those documents also contain information about components, in particular about flame holders, which are intended to stabilize a combustion process.

One important source of thermodynamic losses is a pressure loss which occurs between the compressor section and the turbine section, that is to say over that region of the gas turbine where the flow of compressed air is heated by combustion of a fuel. That pressure loss is governed by the high level of structural complexity, which has always been accepted until now, to produce a combustion device in the form of one or more combustion chambers. Certain rules for reducing the complexity are known. In particular, the already mentioned Published European Patent Application 0 590 297 A1 discloses a so-called "annular combustion chamber" in which the flow is intended to maintain a spin, to which it is subjected in the compressor section, during the combustion of the fuel so that there is no need for any conventional stationary ring of blades at an inlet to the turbine section, in order to initially build up any spin required to operate the turbine section. Reference is also made to U.S. Pat. No. 2,630,678, which was cited initially, and according to which the fuel can be added in the compressor section itself.

In addition to the already mentioned measures for improving the thermodynamic process which takes place in the gas turbine, the increase in the specific power, that is to say the power emitted by the gas turbine per unit amount of energy supplied with the fuel, necessitates an increase in the turbine inlet temperature, that is to say the temperature of the flow after combustion of the fuel and upon entry into the turbine section. The turbine inlet temperature is limited by the load capacity of the components in the turbine section, which is governed in particular by the load capacity of the materials being used and the measures which may be provided to cool the components. Such measures are normally limited by the fact that air required for cooling must be tapped off the flow and is no longer available for combustion. The distribution of the temperature in the flow upon entry into the turbine section is also important. If the distribution of the temperature in the flow upon entry into the turbine section is not uniform, as must be assumed for every turbine produced to date, then the maximum temperature in the flow governs the maximum load on the components in the turbine section and, in order to operate the latter safely, therefore has to be kept below a critical limit while, in contrast, the mean value of the temperature in the flow is the governing factor for the quality of the thermodynamic process and, in particular, for that mechanical power which the thermodynamic process can provide for a given use of primary energy. It follows from those considerations that the specific power of a gas turbine can be increased, without any adverse effect on its life, if it is possible to homogenize the distribution of the temperature in the flow upon entry into the turbine section, and thus to raise the mean value of the temperature to the maximum temperature. Once homogenization has been carried out, the mean value of the temperature in the flow can be raised by increasing the use of primary energy until the predetermined load capacity of the turbine section is reached. The potential of such measures is considerable. Raising the mean value of the temperature in the flow upon entry into the turbine section by about 10° C. can produce an increase in the specific power of more than 1%. Conventional gas turbines invariably have the potential for such measures since the difference between the maximum and the mean value in the distribution of the temperature in the air flow upon entry into a turbine section in such gas turbines is up to 100° C.

The reason for the inhomogeneous distribution of temperature in a flow in a conventional gas turbine is normally the complex and inherently inhomogeneous treatment of the flow and of the fuel between the compressor section and the turbine section. That is true to a particular extent if the flow is split into flow elements and is fed to a plurality of combustion chambers or to a plurality of individual burners.

That is also true in conventional annular combustion chambers, which in each case largely dispense with any splitting of the flow but still provide a plurality of burners, that are necessary at a distance from one another and are intended to heat the flow.

Furthermore, it is necessary to take account of the fact that, in any conventional gas turbine, the flow of compressed air between the compressor section and the turbine section, that is to say where it is heated by combustion of a fuel, is carried without any spin. The major reason therefor is that such a measure can reduce the speed of the flow to a minimum. That is the easiest way to ensure stable combustion of the fuel, while providing maximum flexibility for the construction of burners and the like. In fact, conventional practice demands that guidance devices be provided at the end of the compressor section which extract from the flow any spin that exists downstream of the last rotating compressor stage and, in addition, the turbine section has to have a guidance device at its inlet, which provides the flow with a spin required to act on the first rotating turbine stage. The guidance device in the turbine section, in particular, is the most severely thermally loaded component and must have a correspondingly complex construction. In addition, some pressure reduction occurs even in that guidance device, and thus a temperature reduction, of the combustion gas in the flow. Accordingly, it is not the first rotating turbine stage that governs the maximum possible temperature of the flow, but the guidance device at the inlet of the turbine section which, in fact, does not extract any energy from the flow.

The considerations discussed in the last two paragraphs are of particular importance for modern gas turbines, which are always characterized by the fact that they largely make full use of the limits predetermined by the materials being used. That is done particularly to achieve the maximum possible thermodynamic efficiencies. Gas turbines for stationary use, which have ratings of between 100 MW and 250 MW, have compressor sections which are characterized by pressure ratios between 16 and 30, corresponding to temperatures of between 400° C. and 550° C. at the respective compressor outlet, and as a result of the combustion provide heated combustion gas which reaches temperatures of between 1100° C. and 1400° C. All of the temperatures require the greatest possible care in the construction of the combustion devices and turbine sections and full utilization of the limits predetermined by the materials being used. In particular, the temperatures quoted for compressor outlets must also be regarded as being critical in terms of possible self-ignition of the fuel that is added.

SUMMARY OF THE INVENTION

It is accordingly an object of the invention to provide a method for combustion of a fuel in a gas turbine, as well as a corresponding gas turbine, which overcome the hereinafore-mentioned disadvantages of the heretofore-known methods and devices of this general type and which allow combustion of fuel in a flow while ensuring that a distribution of temperature in the flow is as uniform as possible and while avoiding losses.

With the foregoing and other objects in view there is provided, in accordance with the invention, a method for combustion of a fuel in a gas turbine, which comprises passing a flow of compressed air in a movement direction through a gas turbine from a compressor section to a turbine section having a given geometry; feeding fuel to the flow in the compressor section; burning the fuel in the flow between the compressor section and the turbine section; subjecting the flow to a first spin with a speed component at right angles to the movement direction of the flow when the flow emerges from the compressor section; and increasing the speed component in the movement direction of the flow with the combustion of the fuel, causing a speed of the flow entering the turbine section to correspond to a value predetermined by the given geometry of the turbine section.

The flow is subjected to a first spin when it emerges from the compressor section. The first spin is transformed by the combustion of the fuel in the flow into a second spin, which corresponds to a nominal spin, for which the turbine section is constructed. In order to understand this feature, it must first of all be mentioned that any spin in the flow resulting from heating, as occurs in particular during the combustion of the fuel, is changed, namely reduced. Specifically, the heating produces an increase in the speed at which the flow moves. However, only a component of the speed in the movement direction of the flow is increased. The component of the speed at right angles to the movement direction, representing the spin, cannot naturally be changed by heating the flow. For this reason, under some circumstances certain adaptation measures are required in order to adjust the first spin, with which the flow emerges from the compressor section, in such a way that the second spin, which the flow has upon entry into the turbine section, has a value predetermined by the geometry of the turbine section, in this case called the "nominal spin". It is, of course, desirable to know that such a setting is ensured not only for full-load operation of the gas turbine but also for operating states in which less power is developed than the power produced on full load. A capability is thus preferably provided to control the first spin, that is to say the spin with which the flow emerges from the compressor section, as a function of a thermal power with which heat is produced by the combustion. It is self-evident that control as a function of the thermal power is, in the final analysis, also control as a function of a mechanical power emitted by the gas turbine.

In the sense of the invention, special burners which are disposed between the compressor section and the turbine section in accordance with conventional practice, are avoided and a single burner is provided which extends over the entire cross section of the flow between the compressor section and the turbine section. Since a gas turbine is normally rotationally symmetrical about a longitudinal axis, the burner produced in the sense of the invention is, as a rule, also rotationally symmetrical about the longitudinal axis. This burner is produced by constructing the outlet of the compressor section itself as a burner. No use is made of a conventional combustion chamber or a configuration having a plurality of conventional combustion chambers, nor is any use made of special burners disposed at a distance from one another.

The configuration produced according to the invention, in which the outlet of the compressor section itself acts as a burner, can therefore be called an "integrated pre-mixed area burner" since combustion takes place over the entire cross sectional area of the flow and the components of the burner are integrated in the compressor section. The fact that the fuel is added in the compressor section results in the fuel being naturally premixed with the air. Premixing ensures the formation of a uniform distribution of temperature during and after combustion and the production of nitrogen oxide is also prevented by the absence of any pronounced temperature maxima.

In accordance with another mode of the invention, the fuel is thoroughly mixed with the flow before the fuel is ignited and burnt.

In accordance with a further mode of the invention, a reasonable number of special pilot flames, which point into the flow, are provided to ignite the fuel in the flow. Such pilot flames can be formed by small burners which point in the direction of the flow, irrespective of whether it is moving with a spin or without any spin. They cause local heating and ignition of the fuel/air mixture, which can propagate quickly through the entire flow.

In accordance with an added mode of the invention, the flow is decelerated after being mixed with the fuel. Such deceleration, which can be carried out, in particular, in an annular channel constructed as a diffuser, between the compressor section and the turbine section, can result in the speed of the flow being suitable for stable combustion. This deceleration can possibly also be produced in a special, stationary blade ring. Devices for stabilization of combustion can also possibly be fitted on such a blade ring.

In accordance with an additional mode of the invention, the spin is controlled as a function of a thermal power with which heat is produced by the combustion.

In accordance with yet another mode of the invention, the method is applied when a fuel in the form of a combustible gas is used, in particular natural gas or coal gas. The term "coal gas" is understood to mean any combustible gaseous product of a coal gasification process.

With the objects of the invention in view there is also provided a gas turbine, comprising a compressor section; a turbine section having a given geometric shape; an annular channel for carrying a flow of compressed air in a movement direction from the compressor section to the turbine section; the compressor section giving the flow leaving the compressor section a first spin with a speed component at right angles to the movement direction; nozzles for feeding fuel into the flow in the compressor section for combustion of the fuel causing an increase in the speed component in the movement direction; and the spin together with the increase in the speed component resulting in a speed of the flow governed by the given geometric shape of the turbine section.

Specific advantages and effects of this gas turbine result from the statements relating to the method according to the invention, so that there is no need for any corresponding statements at this point.

In accordance with another feature of the invention, the nozzles are preferably fitted on a stator disk in the compressor section and can, in particular, be integrated in stationary stator blades, which are major components of the stator disk.

In accordance with a further feature of the invention, the nozzles are fitted in hollow stator blades on the stator disk.

In accordance with an added feature of the invention, the stator disk with the nozzles is the penultimate or last stator disk through which the flow passes. Such positioning of the nozzles, with uniform distribution of the fuel in the flow, ensures good reliability against premature ignition of the fuel, as is desirable with regard to the temperature that occurs at the compressor outlet in a modern gas turbine.

In accordance with an additional feature of the invention, the compressor section includes a last stator disk through which the flow passes when it emerges from the compressor section, and which can be adjusted to vary the first spin with which the flow flows behind the last stator disk. Adjustable stator disks for compressor sections are known in principle but, on the basis of previous practice, are used exclusively at the inlet of a compressor section and are used to adjust the inlet cross section through which air is sucked in. In this context, the adjustable stator disk is used, in particular, to adjust the power which the gas turbine is intended to emit. An adjustable last stator disk at the outlet end of a compressor section allows the spin with which the flow leaves the compressor section to be adjusted, particularly as a function of the operating state of the gas turbine. In this way, it is possible to match the spin of the flow for any conceivable operating state to the requirements which the turbine section places on the flow spin. Details relating to this have already been explained.

In accordance with a concomitant feature of the invention, in order to stabilize the combustion, a flame holder is disposed between the compressor section and the turbine section. Such a flame holder is constructed, for example, as a flow obstruction and results in a vortex or reverse-flow region being formed in the flow immediately downstream of the flame holder. Such a vortex region is suitable for forming a largely fixed-position flame, which can be important to ensure stable and complete combustion.

It is likewise preferred for the annular channel between the compressor section and the turbine section to expand like a diffuser. This expansion need not necessarily take place uniformly but, if required, may be more or less sudden. This leads to the formation of a front in the flow, on which the flow is considerably decelerated and on which a stable flame can be formed and maintained. The diffuser can thus act as a flame holder.

It is furthermore preferred for the annular channel between the compressor section and the turbine section to be lined with ceramic heat shield elements, which absorb the thermal load originating from the combustion, with a low cooling requirement.

The gas turbine furthermore preferably has a turbine section in which the flow is fed directly to a rotor disk. This implies that the flow is guided with a spin in the annular channel, and that the combustion takes place in this flow.

In this context, the turbine section has a particularly simple construction since it does not require a stator disk at its inlet, which would cause it to first be necessary to build up a spin required to operate the rotating rotor disks of the turbine section. Such a stator disk at the inlet of the turbine section is one of the most severely thermally loaded components in the gas turbine, with a correspondingly high cooling requirement that conventionally must be covered at the cost of air provided for combustion, and with corresponding requirements for the material to be used for production. A particularly economical gas turbine can thus be achieved through the use of the invention.

Other features which are considered as characteristic for the invention are set forth in the appended claims.

Although the invention is illustrated and described herein as embodied in a method for combustion of a fuel in a gas turbine, as well as a corresponding gas turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is an elevational view of an exemplary embodiment of the invention which is partly diagrammatic and/or distorted in order to emphasize specific features. This does not mean that the drawing is no longer a true image of the shape of a gas turbine which can actually be constructed. In order to supplement the information which can be obtained from the drawing and its associated description, reference is made to the cited documents relating to the prior art and to the general specialist knowledge of the relevantly active average person skilled in the art.

DESCRIPTION OF THE PREFERRED EMBODIMENTS

Referring now in detail to the single figure of the drawing, there is seen a gas turbine 1 with a compressor section 2 and a turbine section 3. The compressor section 2, only part of which is illustrated, sucks air in from the environment of the gas turbine 1, compresses it, and provides it as a flow 4 of compressed air. Fuel 5 is added through nozzles 6 to the flow 4 in the compressor section 2. When the flow 4 emerges from the compressor section 2, it has a first spin 7, that is to say a speed component which is directed at right angles to the direction in which the flow 4 is moving. Under some circumstances, this first spin 7 is changed until the flow 4 reaches the turbine section 3, and a second spin 8 is produced at an inlet of the turbine section 3. The change is caused to a major extent by combustion of the fuel 5, which is initiated by pilot flames 9 that project into the flow 4, between the compressor section 2 and the turbine section 3. The pilot flames 9 are formed by fuel which is fed through corresponding nozzles 10. As a rule, there are a plurality or a large number of pilot flames 9, although for the sake of clarity only one of the pilot flames 9 is illustrated. There is no stationary stator disk in accordance with conventional practice at the inlet of the turbine section 3. Instead, the first item is a rotor disk 11. Specifically, it is possible to dispense with a stator disk at the inlet of the turbine section 3 through appropriate adjustment of the second spin 8.

The nozzles 6 through which the fuel 5 is added to the flow 4 are located on a penultimate stator disk 12 in the compressor section 2. In particular, the nozzles 6 are openings from channels in corresponding hollow stator blades that are disposed jointly and in the form of a ring and which form the penultimate stator disk 12. A last stator disk 13 which is disposed at an outlet of the compressor section 2 is formed from stator blades which can be adjusted by corresponding adjusting devices 14. Thus, depending on the operating state of the gas turbine 1, the first spin 7 and thus the second spin 8 can be adjusted and, in particular, can be matched to the requirements of the turbine section 3. Depending on the construction of the gas turbine 1, it may be possible to dispense with a stator disk 12 at the outlet from the compressor section 2.

In order to stabilize the combustion of the fuel 5 in the flow 4, flame holders 15 are provided between the compressor section 2 and the turbine section 3. The specific structure of these flame holders 15 is of little importance, not in the least because many types of flame holders are known from the prior art and can be used in the present case. In the illustrated exemplary embodiment, the flame holder 15 is, for example, a firmly anchored bar that projects into an annular channel 16 through which the flow 4 moves from the compressor section 2 to the turbine section 3. The important factor is that a vortex is formed downstream of the flame holder 15, on which a flame can stabilize. This function can be carried out not only by bars but also by components having other structures.

The fuel 5 is fed to the nozzles 6 and 10 through appropriate fuel pipes 17 and fuel pumps 18 from a fuel supply 19. The fuel supply 19 may be any form of reservoir, but it is also conceivable for the fuel supply 19 to be a public supply network, in particular for gaseous fuels such as natural gas. It is also conceivable for the fuel supply 19 to be part of a system in which coal is gasified and a combustible gaseous product, namely coal gas, is obtained which can be used as a fuel for the gas turbine 1.

In order to provide protection against excessive thermal loads, the structures of the gas turbine 1 which form the annular channel 16 are protected by a heat shield which is formed, for example, by ceramic heat shield elements 20. Many different types of such heat shields are known in the relevant prior art, so that further statements at this point are superfluous.

The invention relates to a gas turbine and to a method for combustion of a fuel in a flow of compressed air which passes through a gas turbine from a compressor section to a turbine section, wherein the fuel is burnt between the compressor section and the turbine section and the fuel is added to the flow in the compressor section. The invention allows considerable simplification of the construction of a gas turbine and, by avoiding pressure losses and friction losses, also results in considerable advantages with respect to the thermodynamics of the energy conversion process that takes place in the gas turbine.

I claim:

1. A method for combustion of a fuel in a gas turbine, which comprises:

passing a flow of compressed air in a movement direction through a gas turbine from a compressor section to a turbine section having a given geometry;

feeding fuel to the flow in the compressor section;

burning the fuel in the flow between the compressor section and the turbine section;

subjecting the flow to a spin with a speed component at right angle to the movement direction of the flow when the flow emerges from the compressor section;

adjusting the spin so that through an increase of the speed component in the movement direction of the flow with the combustion of the fuel, a speed of the flow entering the turbine section is caused that corresponds to a value predetermined by the given geometry of the turbine section; and directly feeding the flow entering the turbine section to a rotor disk.

2. The method according to claim 1, which comprises intensively mixing the fuel with the flow before the fuel is burnt.

3. The method according to claim 1, which comprises igniting the fuel in the flow at pilot flames additionally directed into the flow.

4. The method according to claim 1, which comprises:

mixing the fuel with the flow before the fuel burning step and decelerating the flow after mixing the flow with the fuel.

5. The method according to claim 1, which comprises controlling the spin by adjusting spin generating means in the compressor section as a function of heat that is produced by the combustion.

6. The method according to claim 1, which comprises selecting a combustible gas as the fuel.

7. The method according to claim 1, which comprises selecting natural gas as the fuel.

8. The method according to claim 1, which comprises selecting coal gas as the fuel.

9. A gas turbine, comprising:

a compressor section;

a turbine section having a given geometric shape, an inlet and a rotor disk adjacent said inlet;

an annular channel for carrying a flow of compressed air in a movement direction from said compressor section to said turbine section;

said compressor section giving said flow leaving said compressor section a spin with a speed component at right angles to said movement direction;

a multiplicity of stator disks through which said flow passes in said compressor section, said stator disks including a last stator disk through which said flow passes upon emerging from said compressor section, said last stator disk being adjustable for varying said spin of said flow after said last stator disk;

nozzles for feeding fuel into said flow in said compressor section for combustion of the fuel causing an increase in the speed component in said movement direction;

said flow being directly fed to said rotor disk of said turbine section upon entry of said flow into said turbine section; and said spin together with said increase in the speed component resulting in a speed of said flow governed by said given geometric shape of said turbine section to operate said rotor disk.

10. The gas turbine according to claim 9, including a stator disk in said compressor section, said nozzles disposed on said stator disk.

11. The gas turbine according to claim 9, including a multiplicity of stator disks through which said flow passes in said compressor section, said stator disks including a penultimate stator disk on which said nozzles are disposed.

12. The gas turbine according to claim 9, including a multiplicity of stator disks through which said flow passes in said compressor section, said stator disks including a last stator disk on which said nozzles are disposed.

13. The gas turbine according to claim 10, wherein said stator disk has hollow stator blades in which said nozzles are fitted.

14. The gas turbine according to claim 9, including a flame holder disposed between said compressor section and said turbine section.

15. The method according to claim 1, which comprises adjusting a power output of the gas turbine by adjusting spin generating means in the compressor section.

* * * * *